US007152673B2

(12) United States Patent
Lohbeck

(10) Patent No.: US 7,152,673 B2
(45) Date of Patent: Dec. 26, 2006

(54) CONTRACTABLE AND EXPANDABLE TUBULAR WELLBORE SYSTEM

(75) Inventor: Wilhelmus Christianus Maria Lohbeck, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/491,703

(22) PCT Filed: Oct. 4, 2002

(86) PCT No.: PCT/EP02/11133

§ 371 (c)(1),
(2), (4) Date: Aug. 27, 2004

(87) PCT Pub. No.: WO03/031771

PCT Pub. Date: Apr. 17, 2003

(65) Prior Publication Data

US 2005/0000686 A1 Jan. 6, 2005

(30) Foreign Application Priority Data

Oct. 5, 2001 (EP) ..... 01308525

(51) Int. Cl.
*E21B 43/10* (2006.01)
*E21B 29/10* (2006.01)

(52) U.S. Cl. ..... 166/207; 166/242.2; 166/277; 138/118.1

(58) Field of Classification Search ..... 166/277, 166/207, 242.2; 138/115, 118, 118.1
See application file for complete search history.

(56) References Cited

U.S. PATENT DOCUMENTS 347,416 A * 8/1886 Buckingham ..... 138/119
1,233,888 A 7/1917 Leonard
3,508,587 A * 4/1970 Mauch ..... 138/119
3,648,895 A * 3/1972 Strazdins ..... 222/107
4,124,985 A * 11/1978 Maimets ..... 405/150.1
5,141,360 A * 8/1992 Zeman ..... 405/43
5,224,796 A * 7/1993 Zeman ..... 405/43
5,337,823 A 8/1994 Nobileau ..... 166/277
5,901,789 A * 5/1999 Donnelly et al. ..... 166/381
2005/0039910 A1* 2/2005 Lohbeck ..... 166/242.1

FOREIGN PATENT DOCUMENTS

| | | |
|---|---|---|
| CN | 1298469 | 6/2001 |
| WO | 99/55999 | 11/1999 |
| WO | 99/56000 | 11/1999 |
| WO | 00/26502 | 5/2000 |

* cited by examiner

*Primary Examiner*—Jennifer H. Gay

(57) ABSTRACT

A tubular system arranged in a wellbore, having an outer tube extending into the wellbore and a wall with at least one section of reduced bending stiffness, each section defining a hinge allowing the outer tube to move between a collapsed mode and an expanded mode. An inner tube extends into the outer tube and has a wall with at least one section of reduced bending stiffness, each section defining a hinge allowing the inner tube to move between a collapsed mode and an expanded mode. With the tubes in their respective expanded modes, the inner tube supports the outer tube and is oriented in the outer tube such that each hinge of the inner tube is circumferentially displaced from each hinge of the outer tube.

7 Claims, 2 Drawing Sheets

CONTRACTABLE AND EXPANDABLE TUBULAR WELLBORE SYSTEM

The present application claims priority on European Patent Application 01308525.3 filed on 5 Oct. 2001.

FIELD OF THE INVENTION

The present invention relates to a tubular system arranged in a wellbore, comprising a tube extending into the wellbore and having a wall with at least one section of reduced bending stiffness, each section of reduced bending stiffness defining a hinge allowing the tube to move between a collapsed mode in which the tube has a relatively small cross-sectional size and an expanded mode in which the tube has a relatively large cross-sectional size.

BACKGROUND OF THE INVENTION

WO 99/55999 discloses such system wherein the tube forms a wellbore casing which stabilises the borehole wall and prevents collapse of the borehole.

A drawback of the known system is that the collapse resistance of the tube, when in the expanded mode, is lower than conventional tubular elements without hinges.

In accordance with the invention there is provided a tubular system arranged in a wellbore, comprising:

an outer tube extending into the wellbore and having a wall with at least one section of reduced bending stiffness, each section of reduced bending stiffness defining a hinge allowing the outer tube to move between a collapsed mode in which the outer tube has a relatively small cross-sectional size and an expanded mode in which the outer tube has a relatively large cross-sectional size;

an inner tube extending into the outer tube and having a wall with at least one section of reduced bending stiffness, each section of reduced bending stiffness defining a hinge allowing the inner tube to move between a collapsed mode in which the inner tube has a relatively small cross-sectional size and an expanded mode in which the inner tube has a relatively large cross-sectional size;

wherein, when said tubes are in their respective expanded modes, the inner tube supports the outer tube and is oriented in the outer tube such that each hinge of the inner tube is circumferentially displaced from each hinge of the outer tube.

By virtue of the staggered arrangement of the respective sets of hinges it is achieved that each hinge of the outer tube is arranged opposite a section of the inner tube of full wall thickness, so that inadvertent/ unintentional bending of the hinges of the outer tube (when in the expanded mode) is prevented.

BRIEF DESCRIPTION OF THE DRAWING

The invention will be described hereinafter in more detail and by way of example with reference to the accompanying drawings in which.

DETAILED EMBODIMENT OF THE INVENTION

Figure 1:
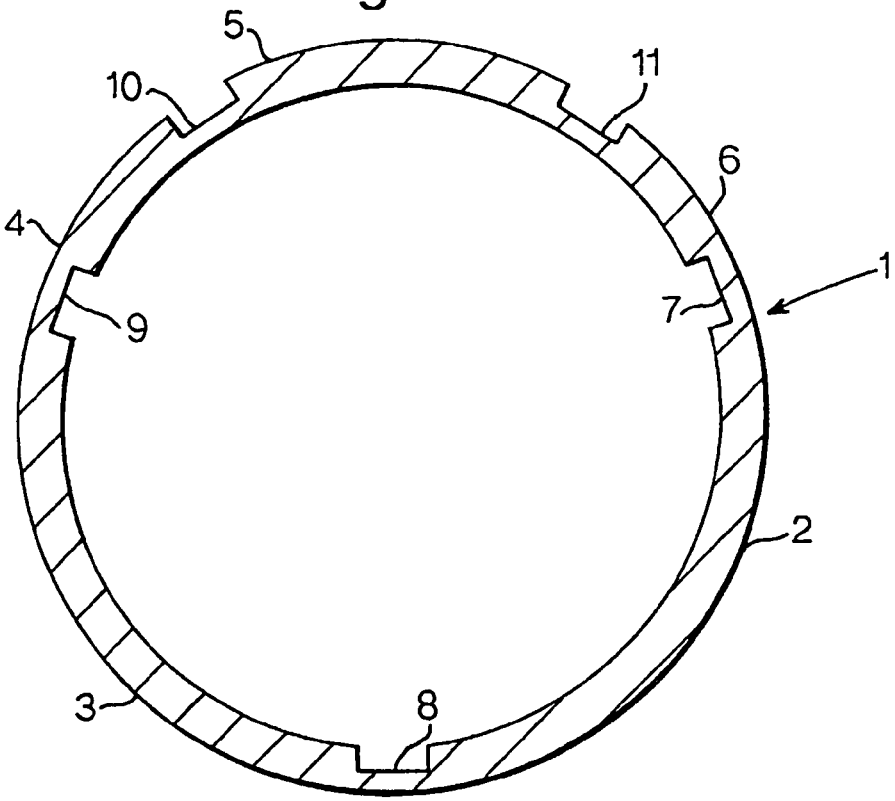
FIG. 1 schematically shows a cross-sectional view of an outer tube in an expanded mode thereof.

Referring to FIG. 1 there is shown a wellbore casing in the form of tubular member 1 which is to be installed in a wellbore (not shown) which has been drilled in an earth formation, whereby the tubular member 1 in the final position thereof is either directly surrounded by the rock formation (not shown) optionally with a cement bonding agent or rubber sleeve inbetween, or is surrounded by another wellbore tubular member. The tubular member 1 will be referred hereinafter as an "outer tube 1" in order to distinguish from an "inner tube" referred to hereinafter.

The outer tube 1 has five arcuate sections 2, 3, 4, 5, 6 having a relatively thick wall, and five short sections 7, 8, 9, 10, 11 interconnecting the arcuate sections and having a relatively thin wall. The short sections 7, 8, 9, 10, 11 extend in longitudinal or near longitudinal direction of the outer tube 1. By virtue of their reduced wall thickness, the short sections 7, 8, 9, 10, 11 have a reduced bending stiffness and therefore form plastically deformable hinges. Hereinafter the outer tube 1 when in the rounded cross-sectional shape as shown in FIG. 1, will be referred to as the expanded mode of the outer tube 1.

Figure 2:
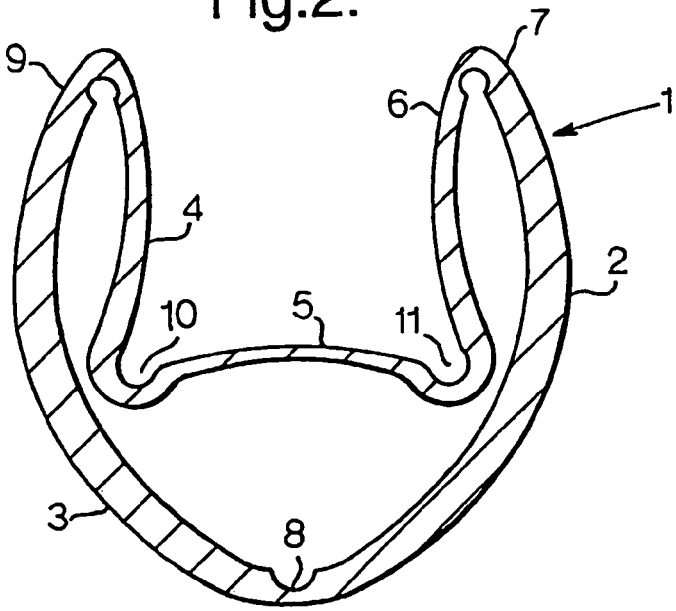
FIG. 2 schematically shows the outer tube in a collapsed mode thereof.

In FIG. 2 is shown the outer tube 1 when in a collapsed mode whereby the outer tube 1 has been bent at the plastic hinges 7, 8, 9, 10, 11 so that arcuate section 5 has moved radially inwards. In the collapsed mode, the outer tube 1 has a smaller cross-sectional size than in the expanded mode, which smaller cross-sectional size allows the outer tube 1 to be transported through the wellbore to the desired location.

Figure 3:
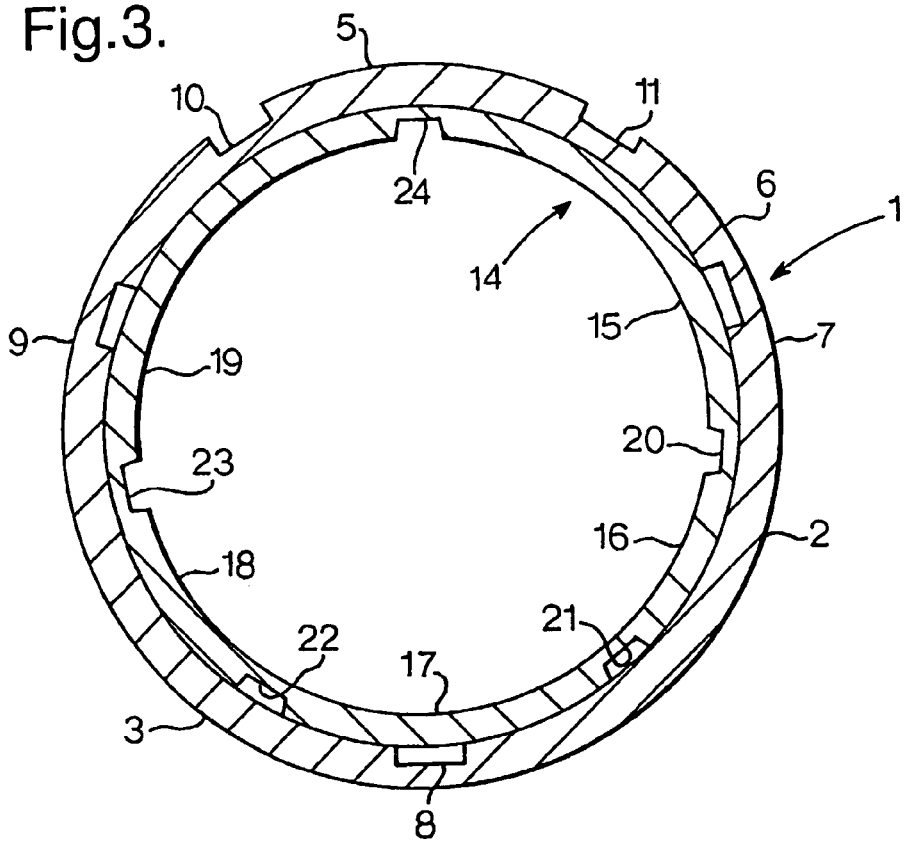
FIG. 3 schematically shows the outer tube and the inner tube, both in their respective expanded modes.

In FIG. 3 is shown an inner tube 14 concentrically arranged within the outer tube 1, whereby the inner tube 14 is biased against the outer tube 1 so as to support the outer tube 1; The inner tube 14 has five arcuate sections 15, 16, 17, 18, 19 having a relatively thick wall, and five short sections 20, 21, 22, 23, 24 interconnecting the arcuate sections 15, 16, 17, 18, 19 and having a relatively thin wall. The short sections 20, 21, 22, 23, 24 extend in longitudinal direction of the outer tube 1. By virtue of their reduced wall thickness, the short sections 20, 21, 22, 23, 24 have a reduced bending stiffness and therefore form plastic hinges. Hereinafter the inner tube 1 when in the rounded cross-sectional shape as shown in FIG. 3, will be referred to as the expanded mode of the inner tube 14.

As shown in FIG. 3 the arrangement of the tubes 1, 14 is such that each hinge 20, 21, 22, 23, 24 of the inner tube 14 is circumferentially displaced from each hinge 7, 8, 9, 10, 11 of the outer tube 1. In other words, the hinges 20, 21, 22, 23, 24 of the inner tube 14 are staggeredly arranged relative to the hinges 7, 8, 9, 10, 11 of the outer tube 1.

Figure 4:
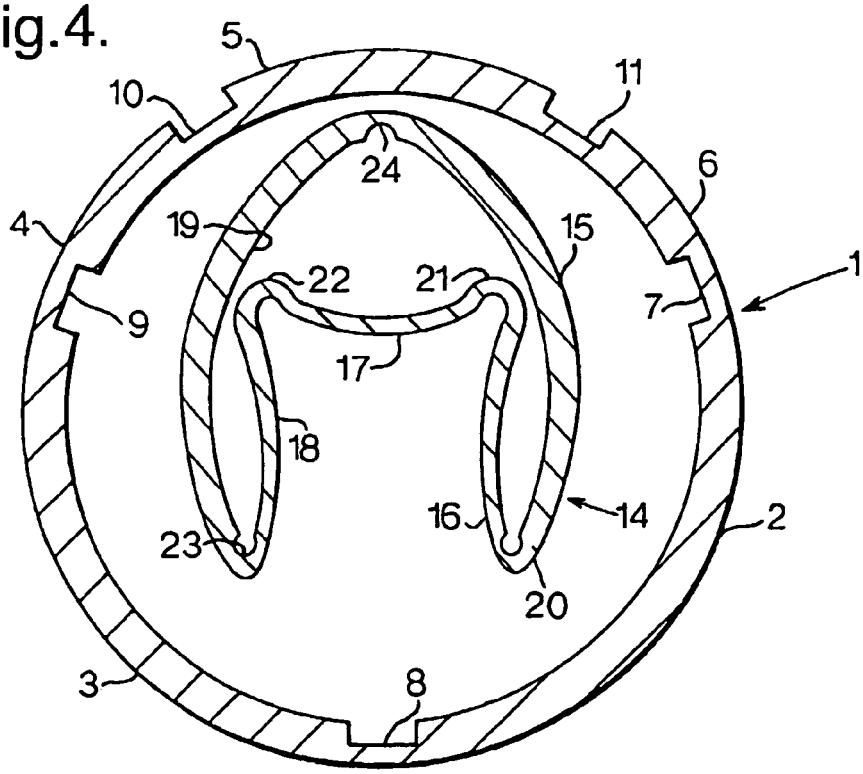
FIG. 4 schematically shows the outer tube in its expanded mode and in inner tube in a collapsed mode.

In FIG. 4 is shown the inner tube 14 when in a collapsed mode thereof whereby the inner tube 14 has been bent at the plastic hinges 20, 21, 22, 23, 24 so that arcuate section 17 has moved radially inwards. In the collapsed mode, the inner tube 14 has a smaller cross-sectional size than in the expanded mode, which smaller cross-sectional size allows the inner tube 14 to be transported through the outer tube 1.

During normal operation an upper part of the wellbore is drilled and provided with an upper casing (not shown) to support the wellbore wall and thereby to prevent collapse of the wellbore. A lower part of the wellbore is then drilled using a drill string (not shown) extending through the upper casing, and subsequently under-reamed to a larger diameter.

The diameter of the under-reamed wellbore is equal to, or slightly larger than, the outer diameter of the outer tube 1 when in its expanded mode.

The outer tube 1 is then brought to its collapsed mode by plastically deforming the outer tube 1 at the hinges 7, 8, 9, 10, 11 to the shape shown in FIG. 2. The outer tube 1 is then lowered through the upper casing to the lower part of the wellbore where the outer tube 1 is suspended by any suitable means. Subsequently the outer tube 1 is brought to its expanded mode by means of, for example, an expander or an inflatable device.

Thereafter the inner tube 14 is brought to its collapsed mode by plastically deforming the inner tube 14 at the hinges 20, 21, 22, 23, 24 to the shape shown in FIG. 4. The inner tube 14 is then lowered through the upper casing into the outer tube 1.

In a next step the inner tube 14 is oriented in the outer tube 1 such that, after expansion of the inner tube 14, the hinges 20, 21, 22, 23, 24 of the inner tube 14 are staggeredly arranged relative to the hinges 7, 8, 9, 10, 11 of the outer tube 1 (as shown in FIG. 3). Subsequently the inner tube 14 is expanded to its expanded mode by means of, for example, a suitable expander (which may be the same expander as used to expand the outer tube 1) or an inflatable device.

With the inner tube 14 expanded against the outer tube 1 whereby the respective sets of hinges are staggeredly arranged, each hinge 7, 8, 9, 10, 11 of the outer tube 1 is arranged opposite a respective arcuate section 15, 16, 17, 18, 19 of the inner tube 14. In this manner it is achieved that the hinges 7, 8, 9, 10, 11 are "locked" so that inadvertent collapse of the outer tube 1 due to external pressure from the rock formation or wellbore fluid (e.g. water, gas or oil) is prevented.

If desired, real hinges can be applied instead of, or in addition to, the plastic hinges for the inner and outer tubes.

To allow for some diameter variation between the tubes, a compressible layer can be applied between the tubes. Also, one or more of the hinges can be formed by a small tubular element (named "cell tube") which has reduced bending stiffness and which accommodates for the diameter variation by virtue of its flattening upon bending.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

The invention claimed is:

1. A tubular system arranged in a wellbore, comprising:

an outer tube extending into the wellbore and having a wall with at least one section of reduced bending stiffness, each section of reduced bending stiffness defining a hinge allowing the outer tube to move between a collapsed mode in which the outer tube has a relatively small cross-sectional size and an expanded mode in which the outer tube has a relatively large cross-sectional size;

an inner tube extending into the outer tube and having a wall with at least one section of reduced bending stiffness, each section of reduced bending stiffness defining a hinge allowing the inner tube to move between a collapsed mode in which the inner tube has a relatively small cross-sectional size and an expanded mode in which the inner tube has a relatively large cross-sectional size;

wherein, when said tubes are in their respective expanded modes, the inner tube supports the outer tube and is oriented in the outer tube such that each hinge of the inner tube is circumferentially displaced from each hinge of the outer tube.

2. The tubular system of claim 1, wherein the tubular system forms a wellbore casing arranged to support the wellbore wall.

3. The tubular system of claim 1, wherein each said tube has at least three said hinges.

4. The tubular system of claim 3, wherein the tube has at least four said hinges.

5. The tubular system of claim 1, wherein each hinge extends in substantially longitudinal direction of the respective tube.

6. The tubular system of claims 1, wherein, when said tubes are in their respective expanded modes, the inner tube is expanded against the outer tube.

7. The tubular system of claims 1, wherein, when said tubes are in their respective expanded modes, the outer tube is expanded against the wellbore wall.

* * * * *